US011787657B2

(12) United States Patent
Bernier

(10) Patent No.: US 11,787,657 B2
(45) Date of Patent: Oct. 17, 2023

(54) APPARATUS AND METHOD FOR APPLYING SELF-ADHESIVE SEAM TAPES TO THE JUNCTIONS OF WATERPROOFING MEMBRANES SO AS TO RENDER THOSE JUNCTIONS WATERPROOF

(71) Applicant: Jaeger USA, Inc., Rochester, NH (US)

(72) Inventor: Jennifer Marie Bernier, Rochester, NH (US)

(73) Assignee: Jaeger USA, Inc., Rochester, NH (US)

( * ) Notice: Subject to any disclaimer, the term of this patent is extended or adjusted under 35 U.S.C. 154(b) by 353 days.

(21) Appl. No.: 16/998,042

(22) Filed: Aug. 20, 2020

(65) Prior Publication Data

US 2021/0053791 A1 Feb. 25, 2021

Related U.S. Application Data

(60) Provisional application No. 62/889,094, filed on Aug. 20, 2019.

(51) Int. Cl.

| | |
|---|---|
| ***B65H 37/04*** | (2006.01) |
| ***B65H 37/00*** | (2006.01) |
| *E04F 15/18* | (2006.01) |

(52) U.S. Cl.

CPC ..... *B65H 37/005* (2013.01); *B65H 37/04* (2013.01); *B65H 2701/377* (2013.01); *E04F 15/18* (2013.01)

(58) Field of Classification Search

CPC ..... B65H 37/005; B65H 37/04

See application file for complete search history.

(56) References Cited

U.S. PATENT DOCUMENTS 3,910,738 A * 10/1975 Chandler ..... E01C 19/43 404/124

7,140,804 B2 * 11/2006 Gregg ..... E01C 19/43 404/93

FOREIGN PATENT DOCUMENTS

GB 1514488 A * 6/1978

* cited by examiner

*Primary Examiner* — Jeffry H Aftergut

(74) *Attorney, Agent, or Firm* — Pandiscio & Pandiscio

(57) ABSTRACT

A seam tape applicator for applying self-adhesive seam tapes to the junctions of dimpled waterproofing membranes, wherein the dimpled waterproofing membranes comprise dimpled surfaces, the seam tape applicator comprising: a body; a roller which is rotatably mounted to the body; and a handle which is attached to the body; wherein the roller comprises a roller surface which comprises surface features which complement the dimpled surfaces of the dimpled waterproofing membranes.

10 Claims, 26 Drawing Sheets

APPARATUS AND METHOD FOR APPLYING SELF-ADHESIVE SEAM TAPES TO THE JUNCTIONS OF WATERPROOFING MEMBRANES SO AS TO RENDER THOSE JUNCTIONS WATERPROOF

REFERENCE TO PENDING PRIOR PATENT APPLICATION

This patent application claims benefit of prior U.S. Provisional Patent Application Ser. No. 62/889,094, filed Aug. 20, 2019 by Jaeger USA, Inc. and Jennifer Marie Savinelli for APPARATUS AND METHOD FOR APPLYING SELF-ADHESIVE SEAM TAPES TO THE JUNCTIONS OF WATERPROOFING MEMBRANES SO AS TO RENDER THOSE JUNCTIONS WATERPROOF, which patent application is hereby incorporated herein by reference.

FIELD OF THE INVENTION

This invention relates to the construction industry in general, and more particularly to waterproofing membranes for positioning between a subfloor (e.g., a concrete slab) and a finish floor (e.g., a tile floor).

BACKGROUND OF THE INVENTION

In the construction industry, it is common for floors to comprise a subfloor (e.g., a concrete slab) and a finish floor (e.g., a tile floor). In this type of construction, it is also common to provide one or more membranes between the subfloor and the finish floor. These membranes may be for a variety of purposes, e.g., to provide sound control, to provide waterproofing, etc. See, for example, FIG. 1, which shows a waterproofing membrane 5 disposed between a subfloor 10 and a finish floor 15.

The present invention is specifically directed to waterproofing membranes, although it may also be used with other types of flooring membranes.

Waterproofing membranes are frequently provided in large sheets which are laid out on the subfloor. See FIG. 2. These waterproofing membranes are typically positioned alongside one another so as to cover the complete subfloor, with a seam lying at the junction of two waterproofing membranes. See FIG. 3, which shows a seam 20 at the junction of two waterproofing membranes 5. In order to provide a waterproof surface, this seam line must be sealed. To this end, mortar may be overlaid along the seam line. See FIG. 4, which shows mortar 25 covering the seam line 20 at the junction of two waterproofing membranes 5.

While mortar can provide an adequate seal to the seam line, it can also be inconvenient and time-consuming to prepare and apply the mortar. To that end, self-adhesive seam tapes have also been developed. See FIG. 5, which shows a self-adhesive seam tape 30 overlying the seam line 20 at the junction of two waterproofing membranes 5. These self-adhesive seam tapes are typically set into position by hand, and then a flat roller is used to press the self-adhesive seam tapes into sealing contact with the waterproofing membranes, whereby to provide a waterproof junction. See, for example, FIG. 6, which shows a flat roller 35 which may be used to press the self-adhesive same tapes 30 into sealing contact with the water proofing membranes 5, whereby to provide the waterproof junction at the seam lines 20.

However, in some cases, the waterproofing membranes may have a dimpled surface. See, for example, FIG. 7, which shows water proofing membranes 5 which comprise a dimpled surface 40, wherein the dimpled surface 40 comprises a regular pattern of upper surfaces 45 and lower surfaces 50. For the purposes of the present application, the upper surfaces 45 may be considered to collectively constitute the "top surface" of the waterproofing membranes, and the lower surfaces 50 may be considered to constitute the "recesses" of the waterproofing membranes. As discussed above, mortar 25 may be overlaid along the seam line 20 between the dimpled waterproofing membranes 5 so as to provide a waterproof junction (see FIG. 8), but this can be inconvenient and time-consuming. Thus it can be desirable to seal the seam line 20 with self-adhesive seal tapes 30. Unfortunately, when sealing a seam line 20 between dimpled waterproofing membranes 5 using self-adhesive seam tapes 30, a flat roller 35 is unable to provide a waterproof junction.

More particularly, and looking now at FIGS. 9-11, where a flat roller 35 is used to press the self-adhesive seam tapes 30 onto dimpled waterproofing membranes 5, the flat roller 35 is unable to force the self-adhesive seam tape 30 into the recesses 50 of the dimpled waterproofing membranes 5. As a result, a poor seal is created at the junctions between the dimpled waterproofing membranes 5, which can lead to moisture passing through the waterproofing membranes 5 to the subfloor 10.

Therefore, there is a need for a new apparatus and method for applying self-adhesive seam tapes to the junctions of dimpled waterproofing membranes so as to render those junctions waterproof.

SUMMARY OF THE INVENTION

The present invention provides a new apparatus and method for applying self-adhesive seam tapes to the junctions of dimpled waterproofing membranes so as to render those junctions waterproof.

More particularly, the present invention comprises the provision and use of a novel seam tape applicator which applies self-adhesive seam tapes to the junctions of dimpled waterproofing membranes so as to render those junctions waterproof.

The novel seam tape applicator of the present invention comprises a roller having a roller surface which comprises surface features which complement the dimpled surface of the waterproofing membranes. More particularly, the roller surface of the seam tape applicator comprises a cylinder having a smooth floor and a plurality of projections extending upwardly from that smooth floor, with the projections having a size and configuration which complement the recesses of the dimpled waterproofing membranes. As a result, when self-adhesive seam tape is set over a seam line separating two sheets of dimpled waterproofing membranes and the seam tape applicator is thereafter rolled over the self-adhesive seam tape, the smooth floor of the cylinder of the seam tape applicator presses the self-adhesive seam tape against the upper surfaces of the dimpled waterproofing membranes and the projections of the seam tape applicator press the self-adhesive seam tape into the recesses of the dimpled waterproofing membranes, whereby to create a waterproof junction between the dimpled waterproofing membranes.

In one form of the invention, there is provided a seam tape applicator for applying self-adhesive seam tapes to the junctions of dimpled waterproofing membranes, wherein the dimpled waterproofing membranes comprise dimpled surfaces, the seam tape applicator comprising:

a body;

a roller which is rotatably mounted to the body; and a handle which is attached to the body;

wherein the roller comprises a roller surface which comprises surface features which complement the dimpled surfaces of the dimpled waterproofing membranes.

In another form of the invention, there is provided a method for applying self-adhesive seam tapes to the junctions of dimpled waterproofing membranes, wherein the dimpled waterproofing membranes comprise dimpled surfaces, the method comprising:

providing a seam tape applicator comprising:

a body;

a roller which is rotatably mounted to the body; and a handle which is attached to the body;

wherein the roller comprises a roller surface which comprises surface features which complement the dimpled surfaces of the dimpled waterproofing membranes;

positioning a self-adhesive seam tape over a seam line separating two sheets of dimpled waterproofing membranes; and rolling the seam tape applicator over the self-adhesive seam tape, with the roller surface of the seam tape applicator engaging the self-adhesive seam tape so as to press the self-adhesive seam tape into the dimpled surfaces of the dimpled waterproofing membranes.

In another form of the invention, there is provided a system for creating a waterproof structure, the system comprising:

two sheets of dimpled waterproofing membranes, the two sheets of dimpled waterproofing membranes comprising dimpled surfaces, and the two sheets of dimpled waterproofing membrane having a junction;

a self-adhesive seam tape configured to overlie portions of the two sheets of dimpled waterproofing membranes so as to cover the junction; and a seam tape applicator for applying the self-adhesive seam tape to the portions of the two dimpled waterproofing membranes so as to cover the junction, the seam tape applicator comprising:

a body;

a roller which is rotatably mounted to the body; and a handle which is attached to the body;

wherein the roller comprises a roller surface which comprises surface features which complement the dimpled surfaces of the dimpled waterproofing membranes.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

The present invention provides a new apparatus and method for applying self-adhesive seam tapes to the junctions of dimpled waterproofing membranes so as to render those junctions waterproof.

Figure 1:
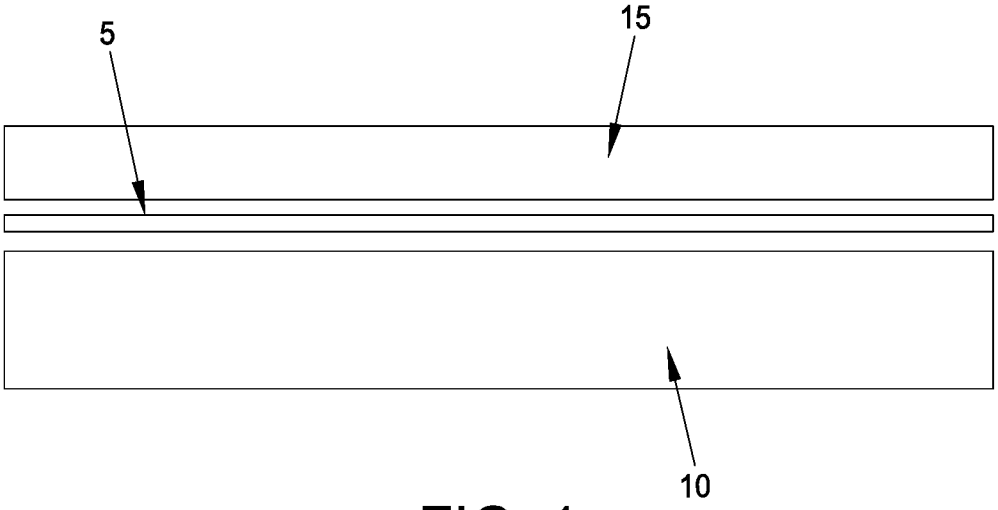
FIG. 1 (PRIOR ART)
FIG. 1 is a schematic view showing a waterproofing membrane disposed between a subfloor and a finish floor.
Figure 2:
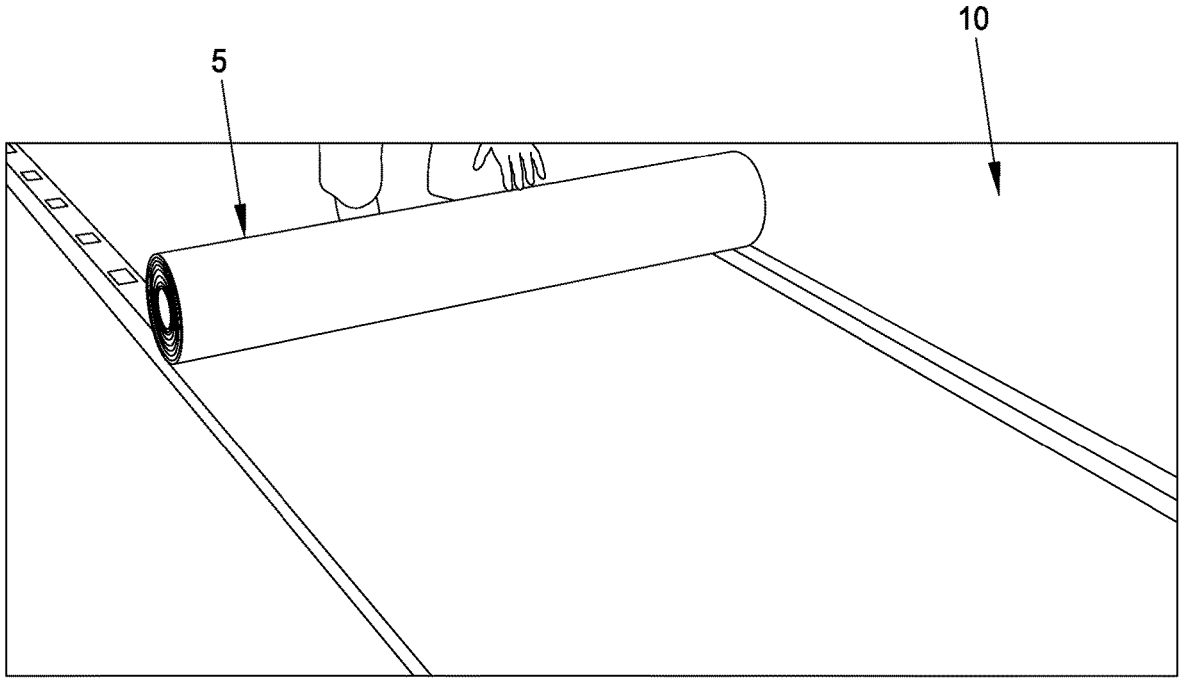
FIG. 2 (PRIOR ART)
FIG. 2 is a schematic view showing a waterproofing membrane being positioned on a subfloor.
Figure 3:
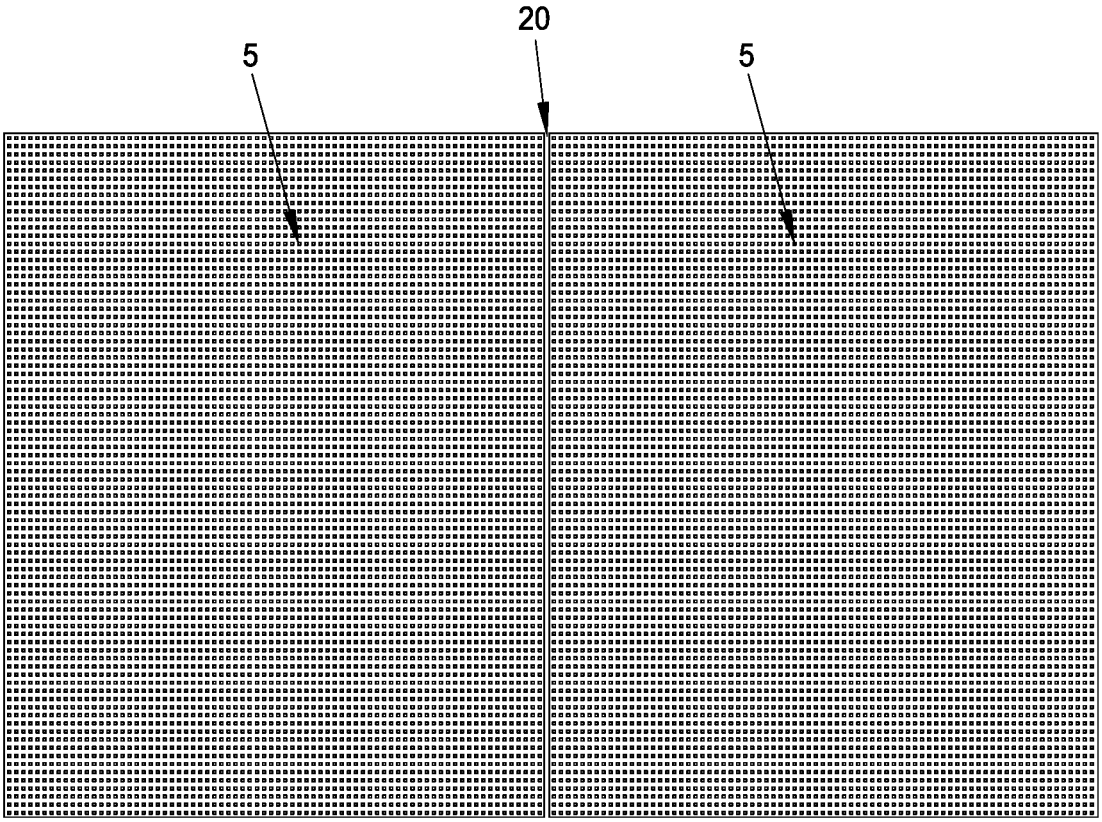
FIG. 3 (PRIOR ART)
FIG. 3 is a schematic view showing the seam line formed between two sheets of waterproofing membranes.
Figure 4:
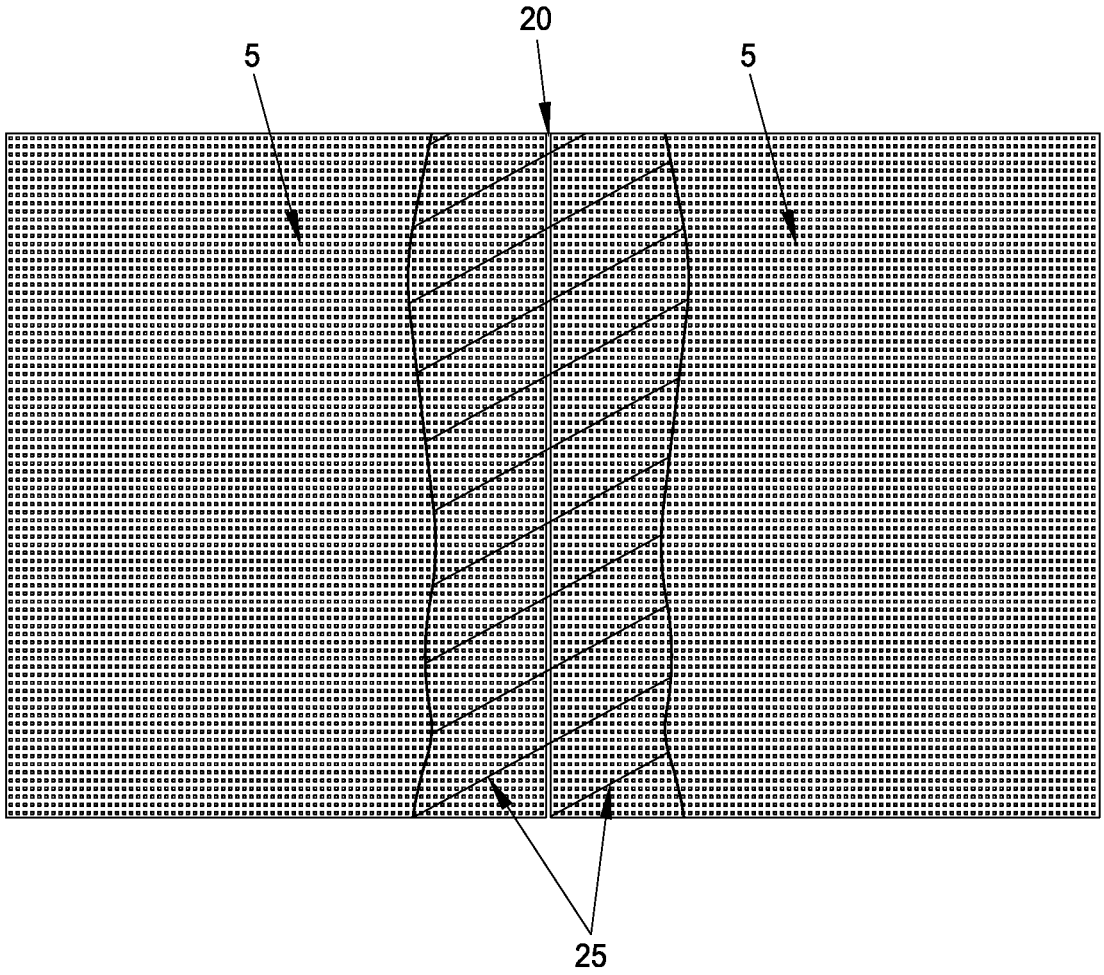
FIG. 4 (PRIOR ART)
FIG. 4 is a schematic view showing mortar overlying the seam line between two waterproofing membranes so as to seal the seam line.
Figure 5:
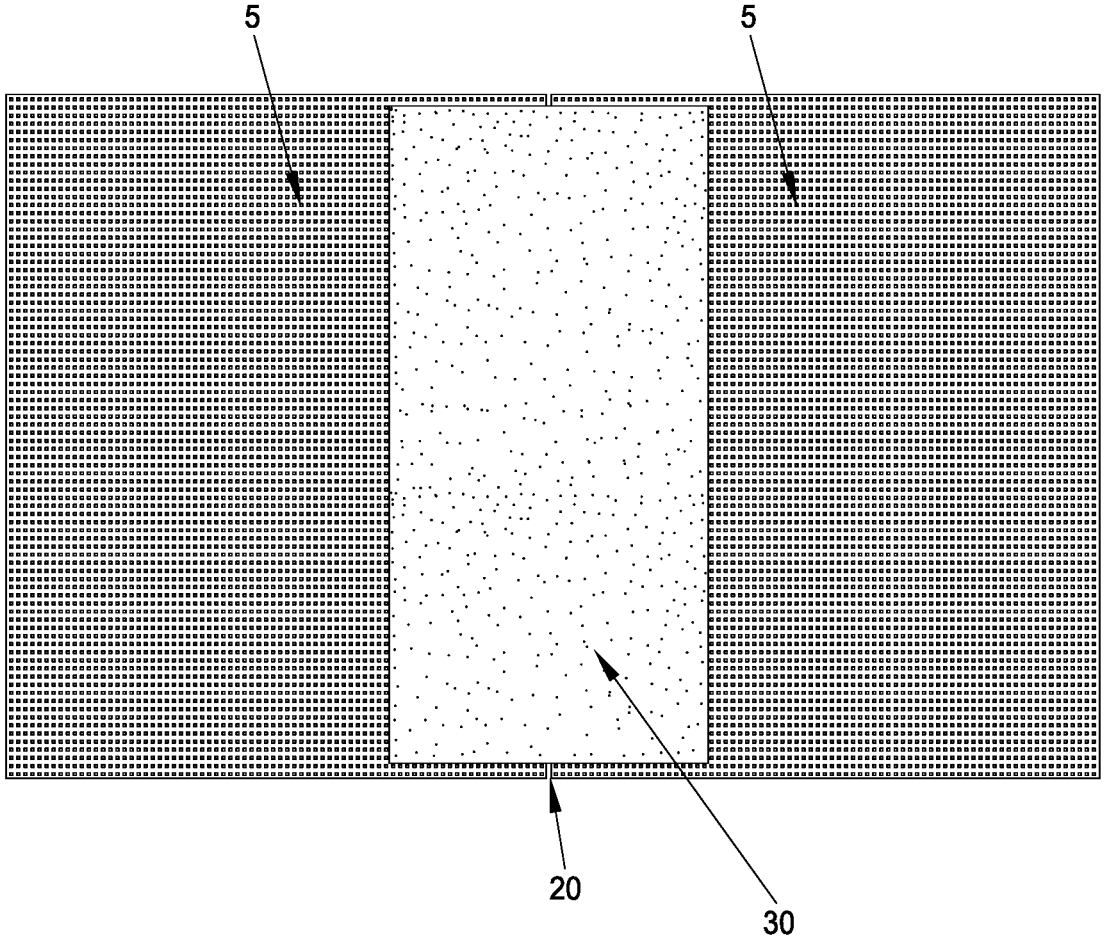
FIG. 5 (PRIOR ART)
FIG. 5 is a schematic view showing self-adhesive seam tape overlying the seam line between two waterproofing membranes so as to seal the seam line.
Figure 6:
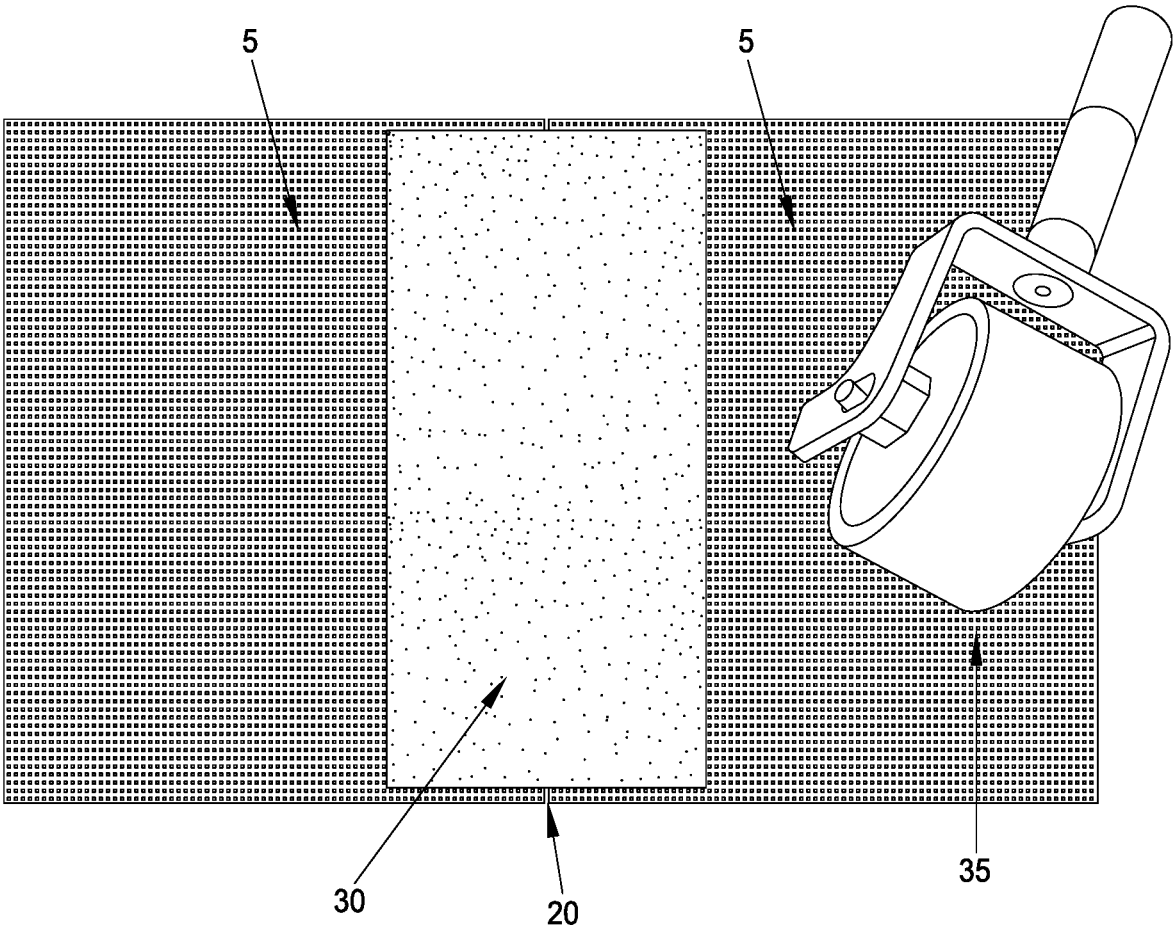
FIG. 6 (PRIOR ART)
FIG. 6 is a schematic view showing a flat roller used to press self-adhesive seam tapes into sealing contact with waterproofing membranes.
Figure 7:
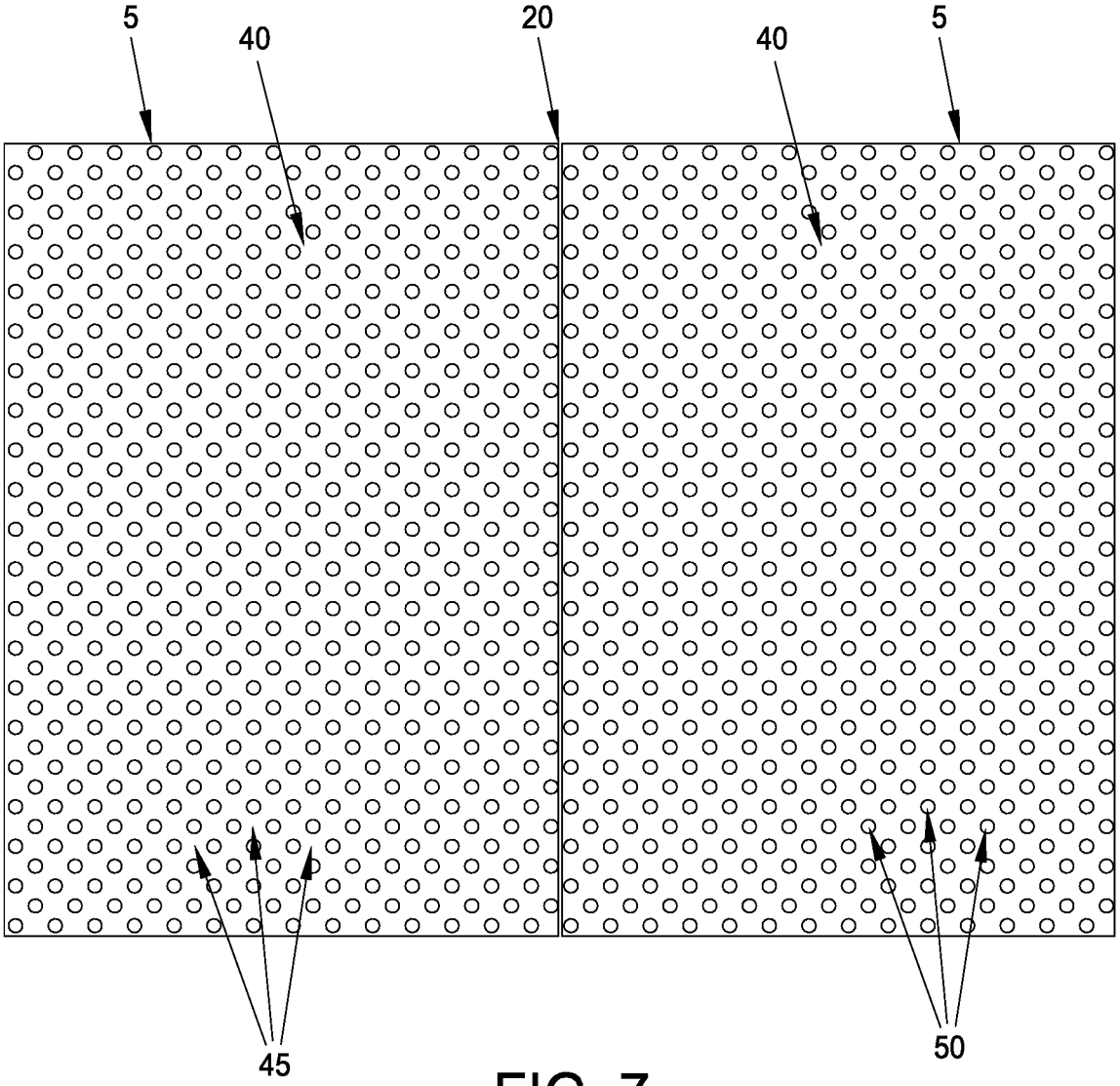
FIG. 7 (PRIOR ART)
FIG. 7 is a schematic view showing two dimpled sheets of waterproofing membranes and the seam line located therebetween.
Figure 8:
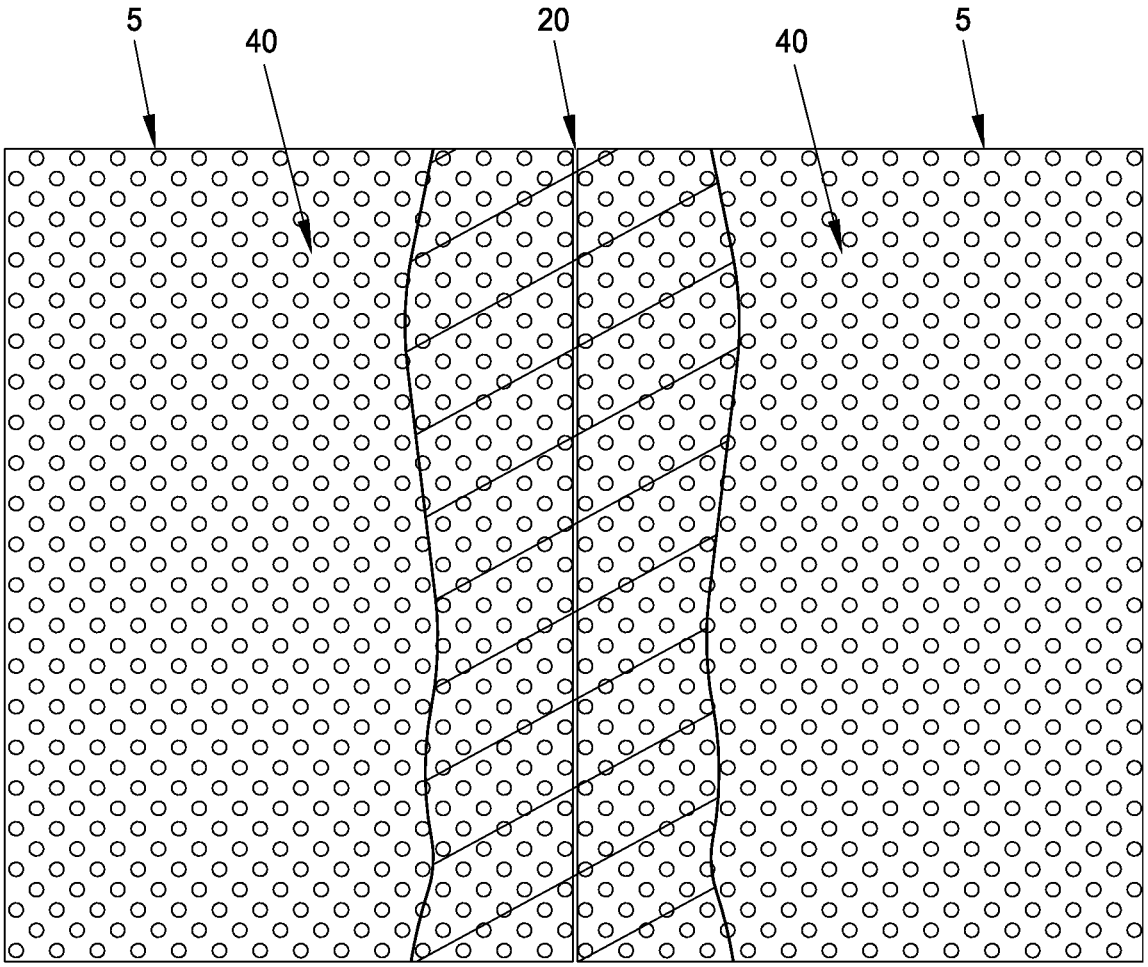
FIG. 8 (PRIOR ART)
FIG. 8 is a schematic view showing mortar overlying the seam line between two dimpled waterproofing membranes so as to seal the seam line.
Figure 9:
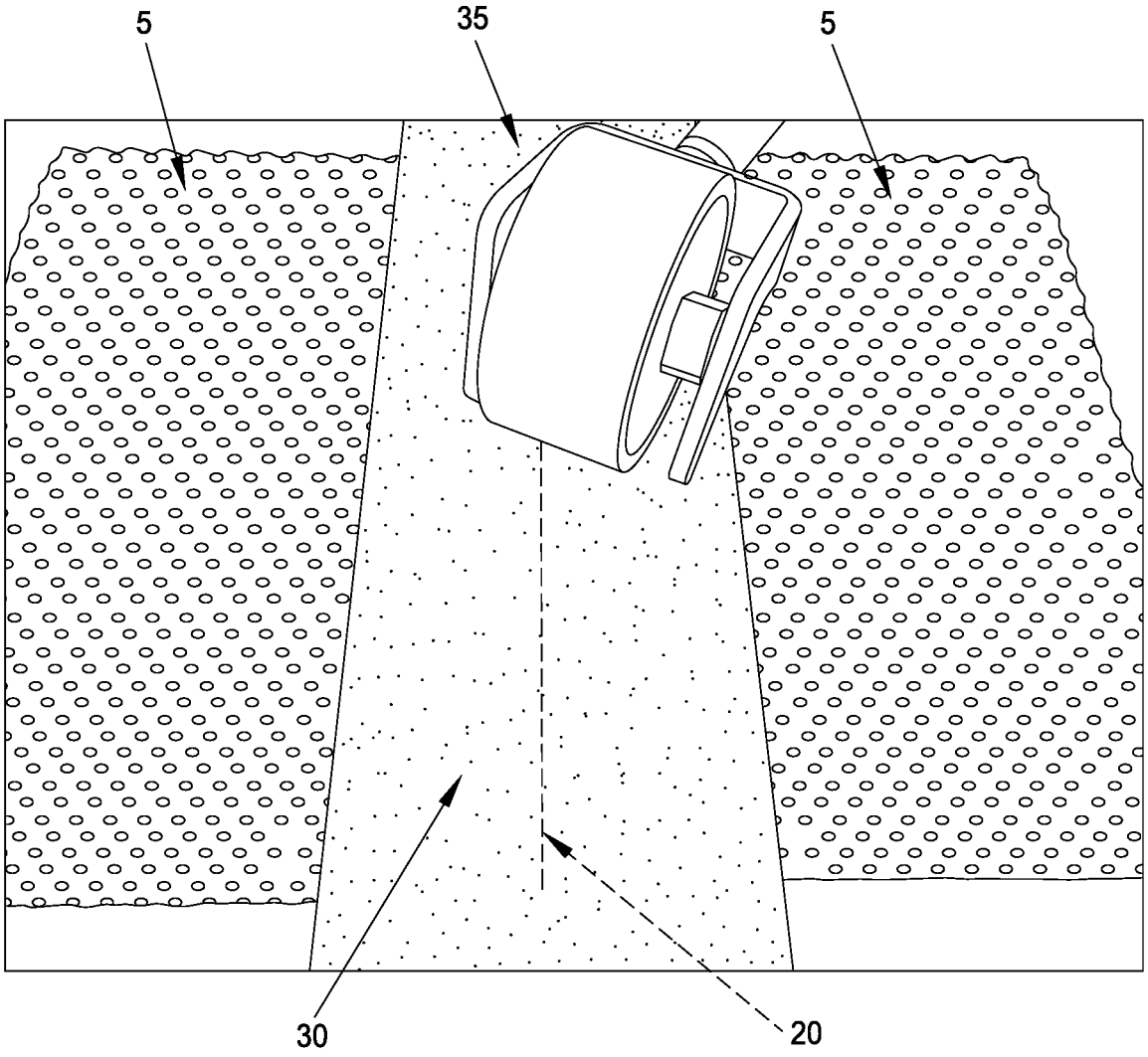
FIG. 9 (PRIOR ART)
FIGS. 9-11 are schematic views showing a flat roller being used to apply self-adhesive seam tape to the seam line between two dimpled waterproofing membranes.
Figure 10:
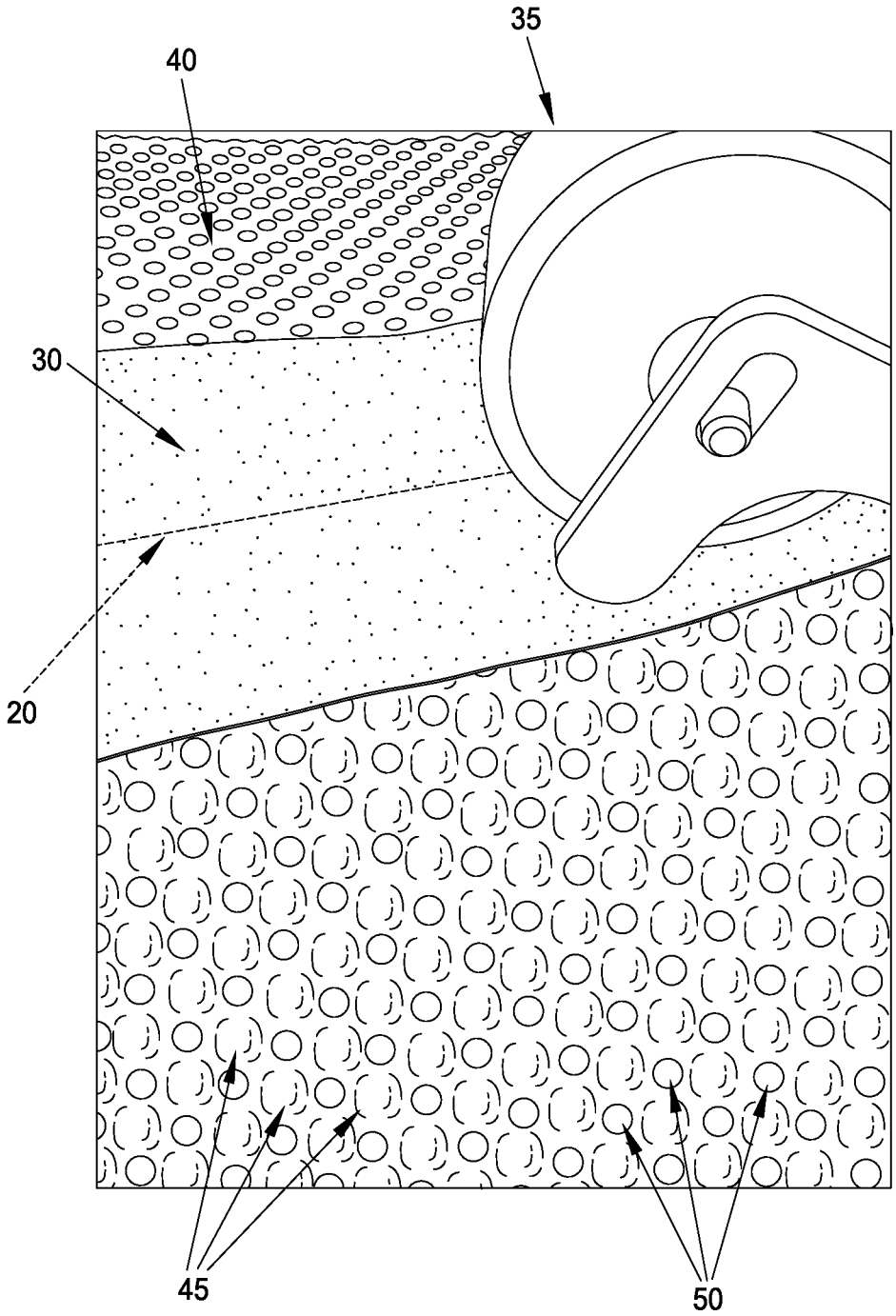
FIG. 10 (PRIOR ART)
Figure 11:
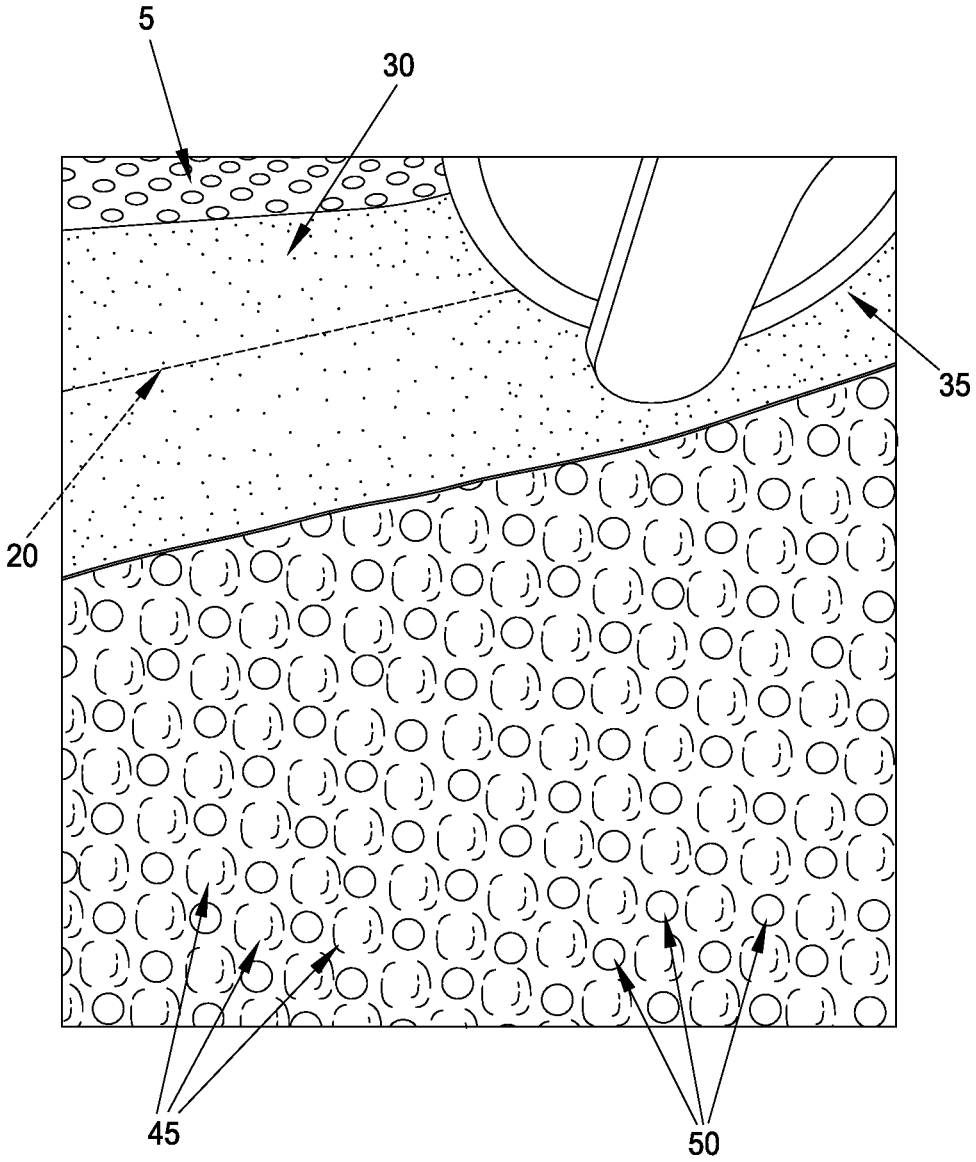
FIG. 11 (PRIOR ART)
Figure 12:
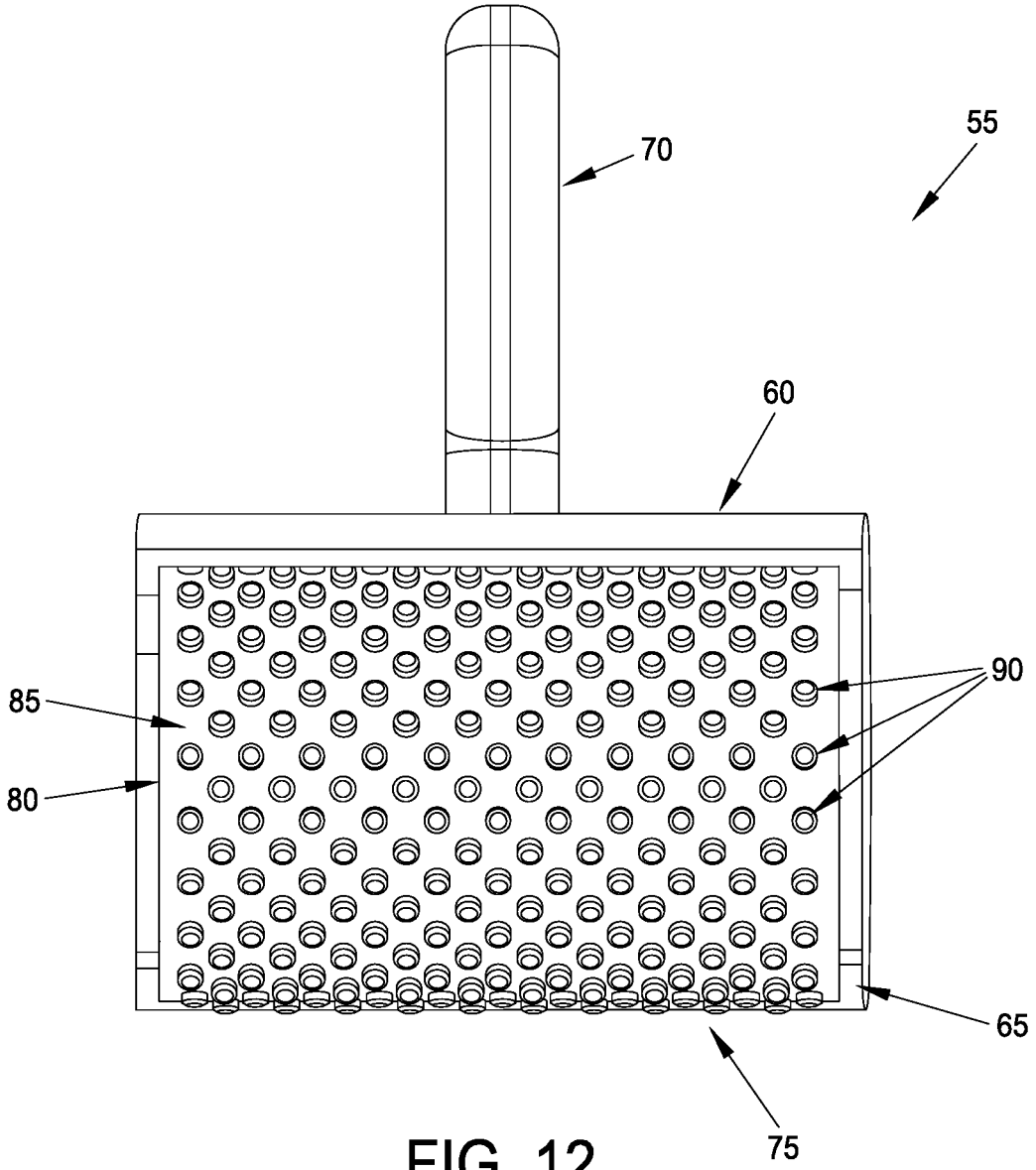
FIGS. 12-17 are schematic views showing a novel seam tape applicator formed in accordance with the present invention.
Figure 13:
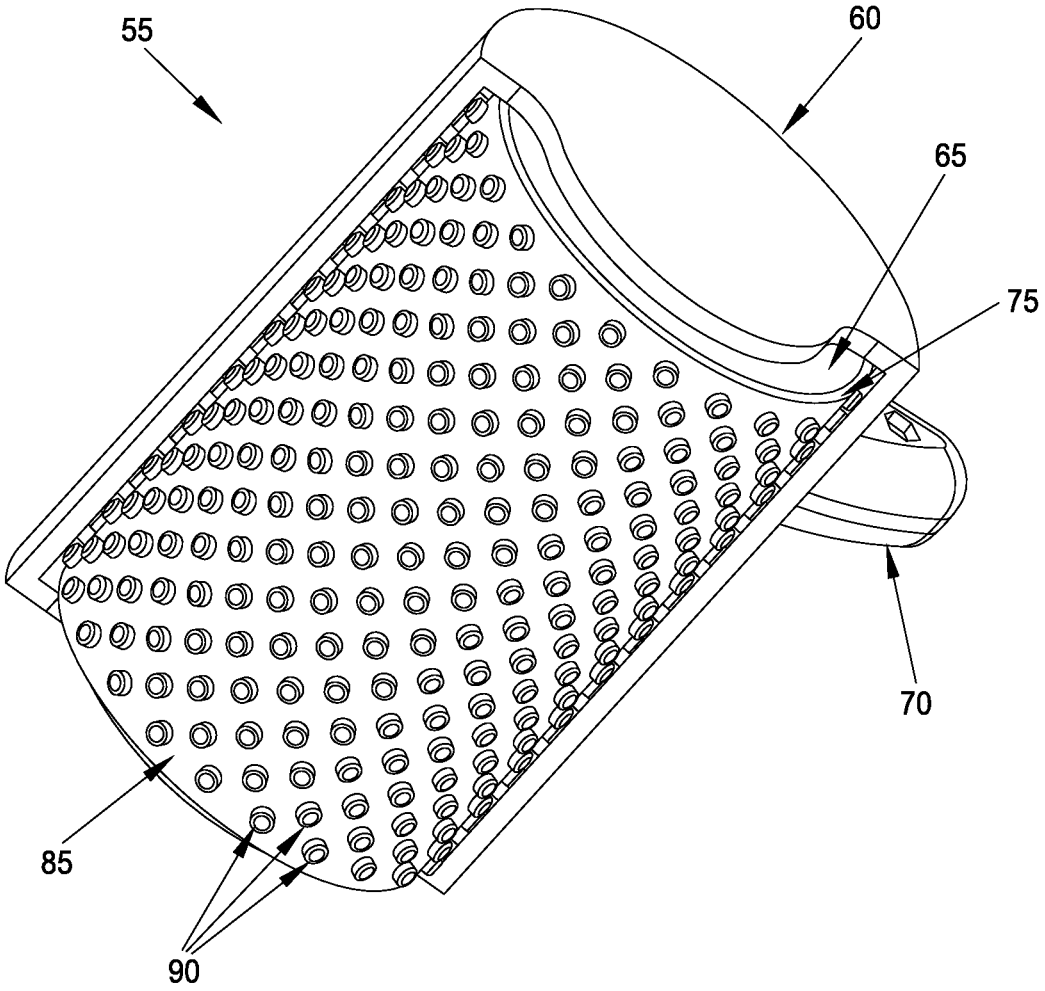
Figure 14:
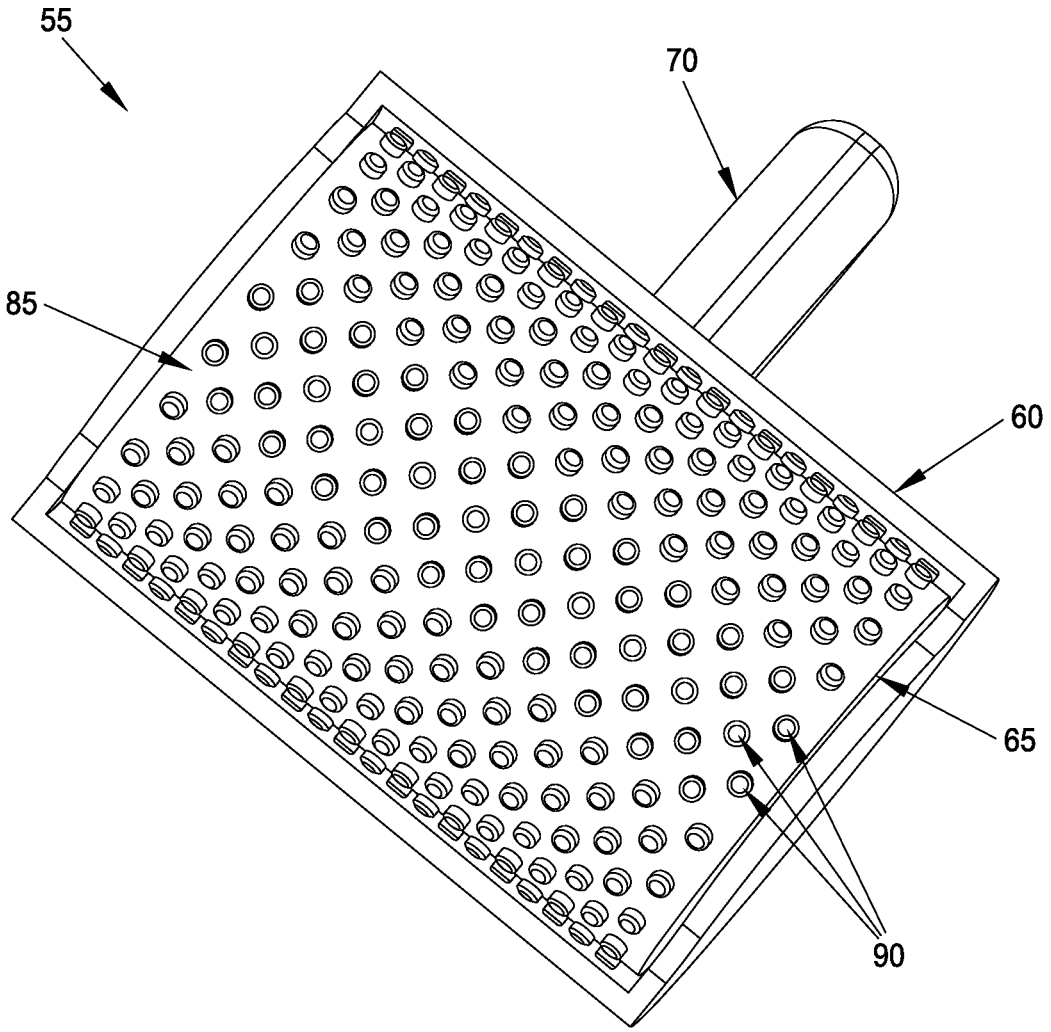
Figure 15:
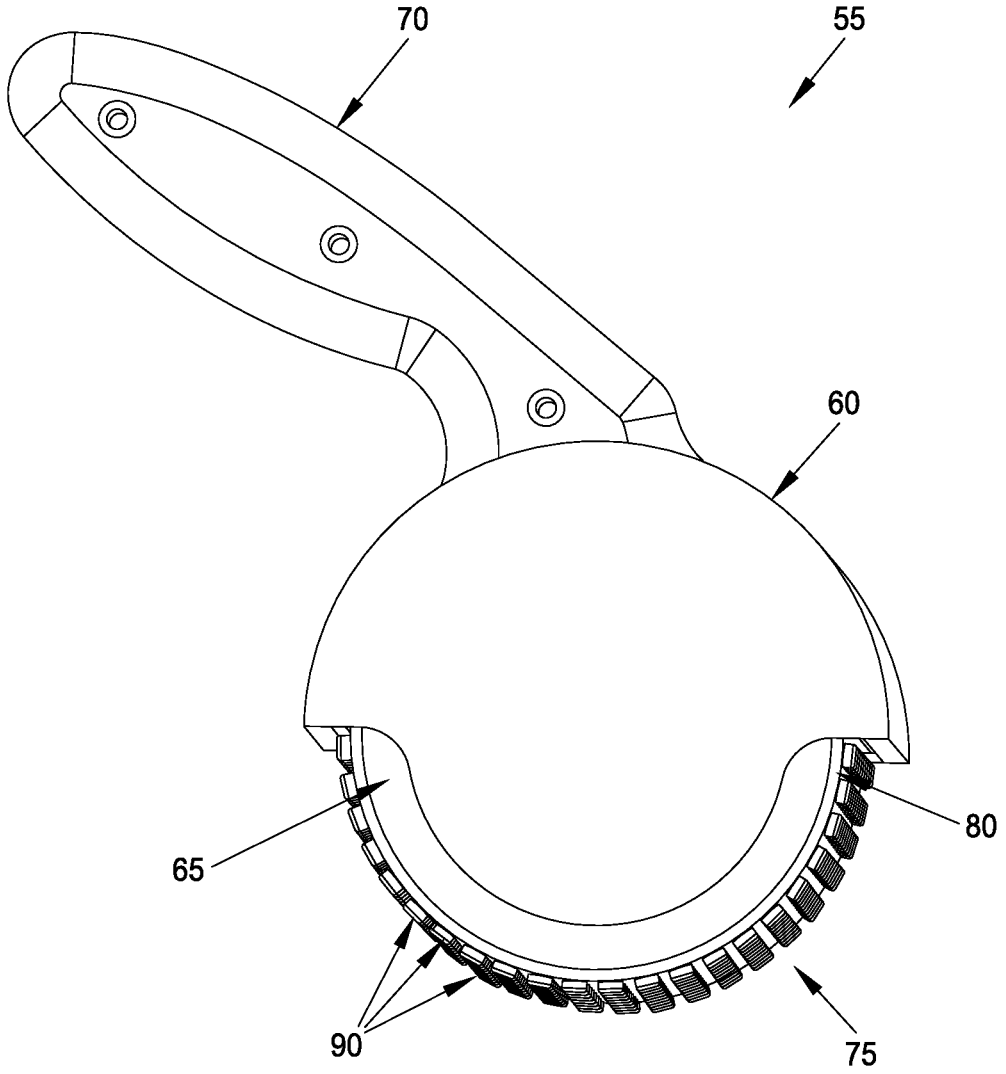
Figure 16:
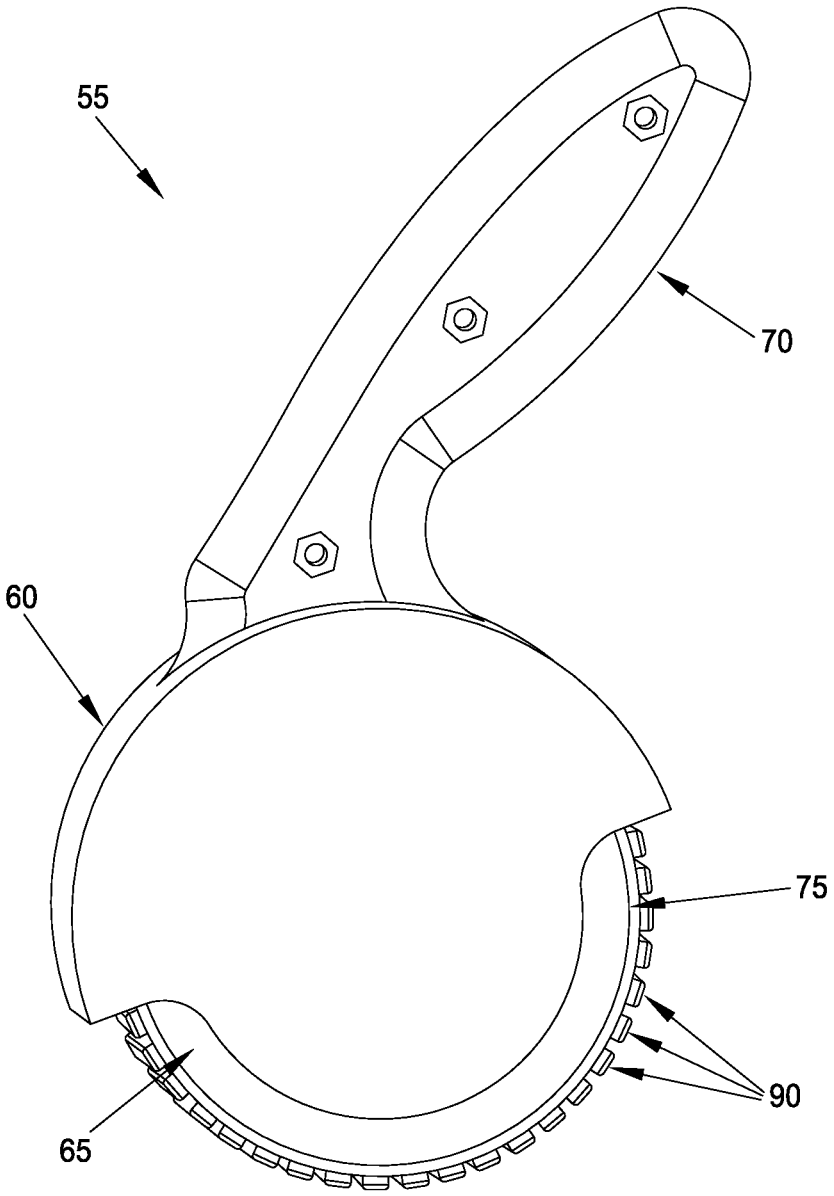
Figure 17:
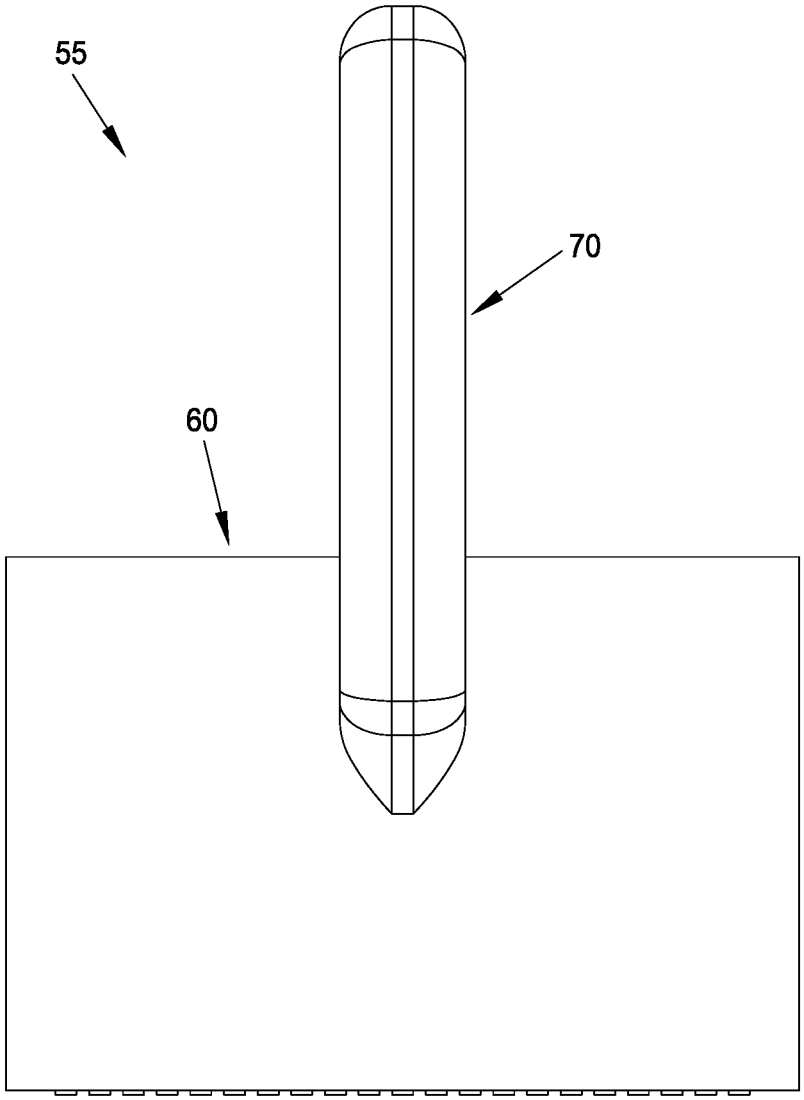
Figure 18:
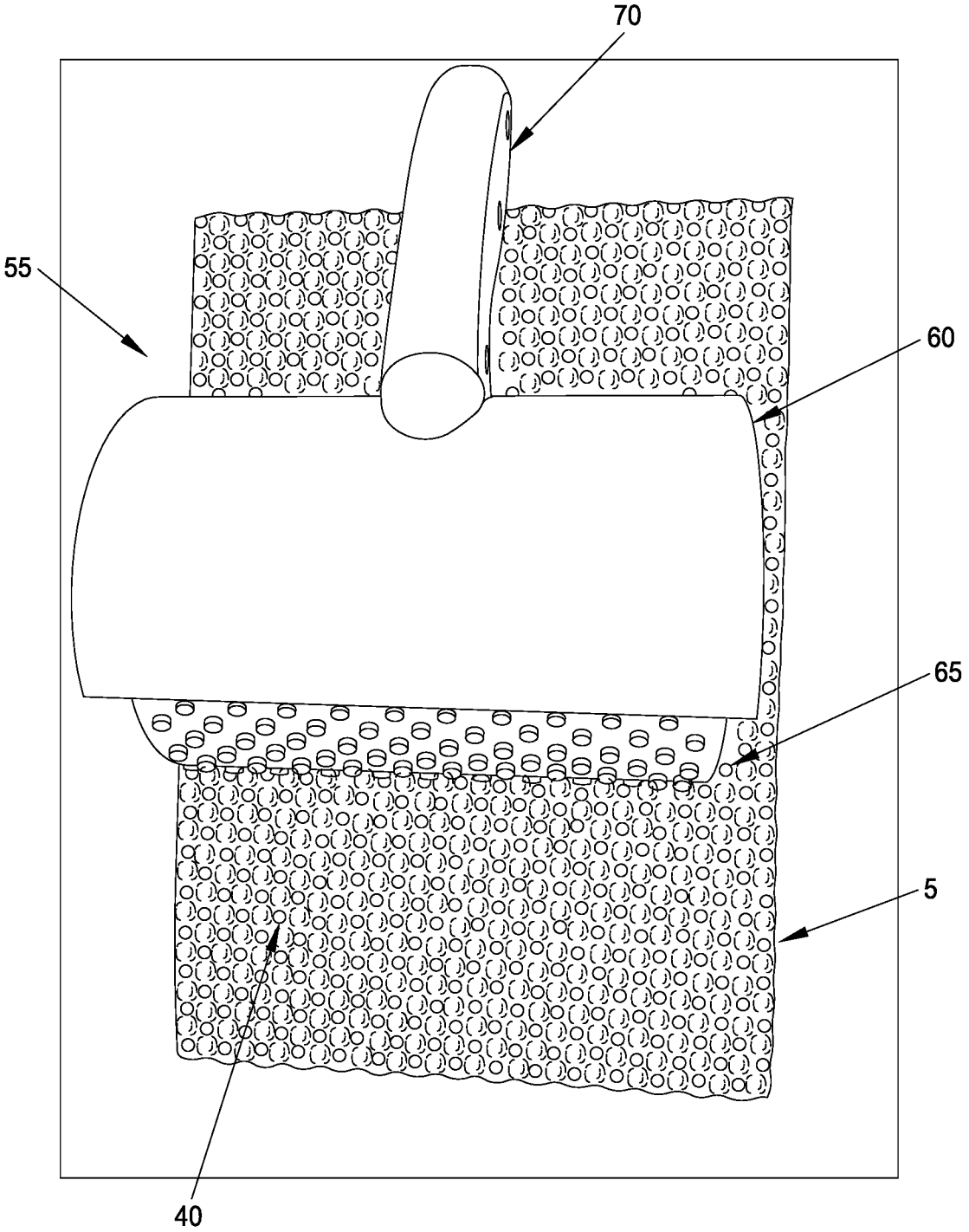
FIGS. 18-20 are schematic views showing how the roller surface of the novel seam tape applicator comprises a plurality of projections having a size and configuration which complement the recesses of the waterproofing membranes.
Figure 19:
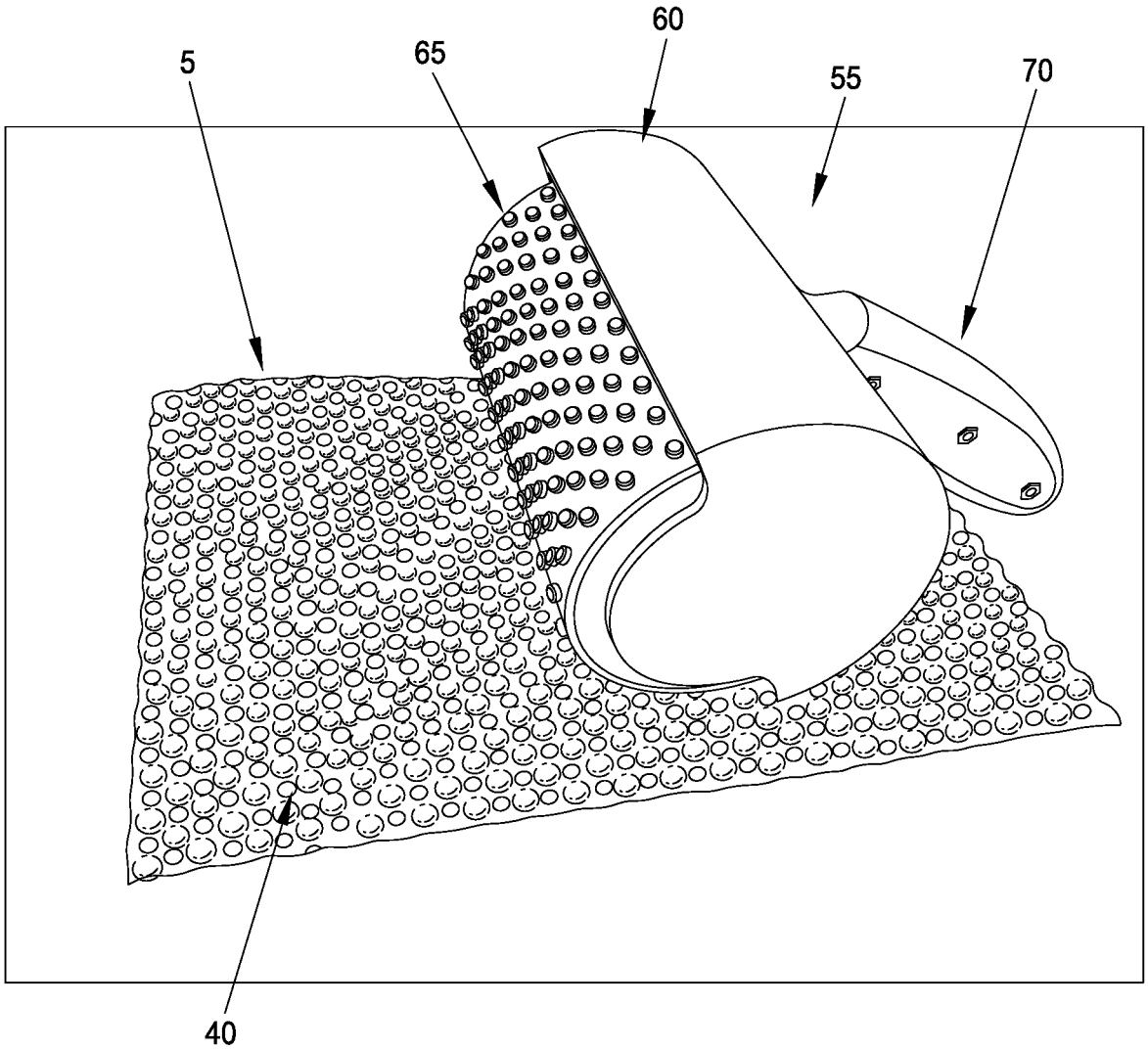
Figure 20:
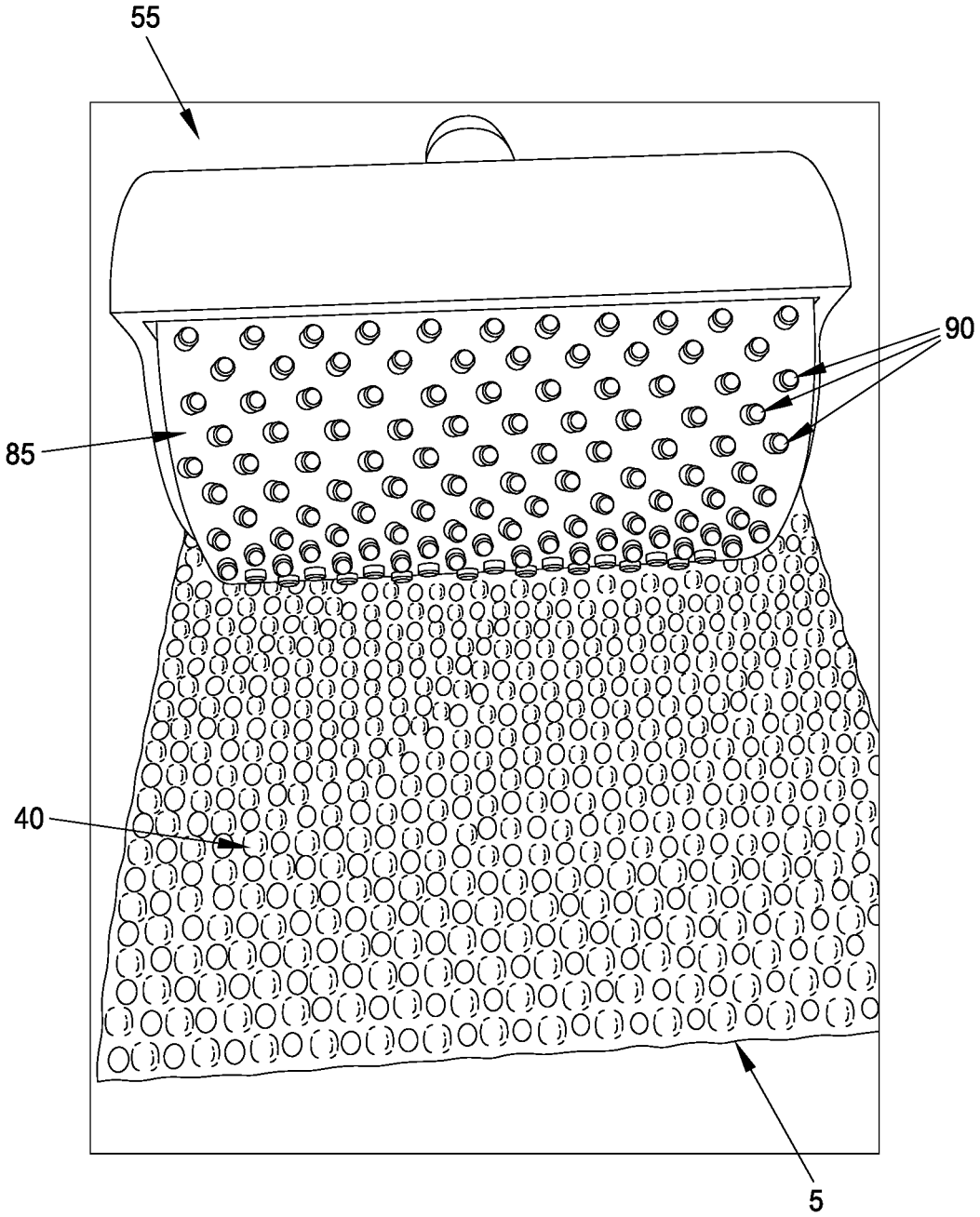
Figure 21:
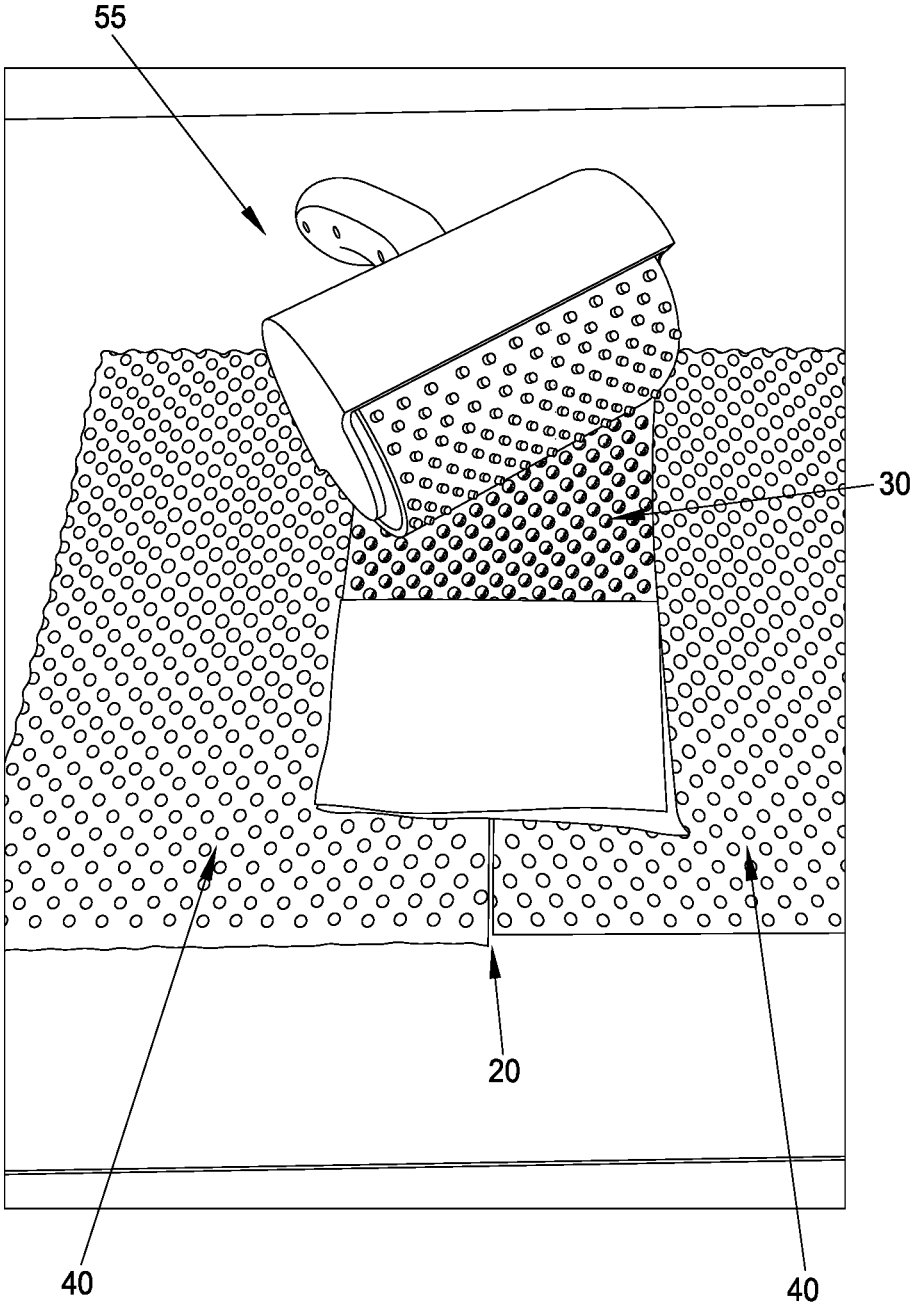
FIGS. 21-25 are schematic views showing how the novel seam tape applicator presses the self-adhesive seam tape into the recesses of the dimpled waterproofing membranes, whereby to create a waterproof junction between the waterproofing membranes.
Figure 22:
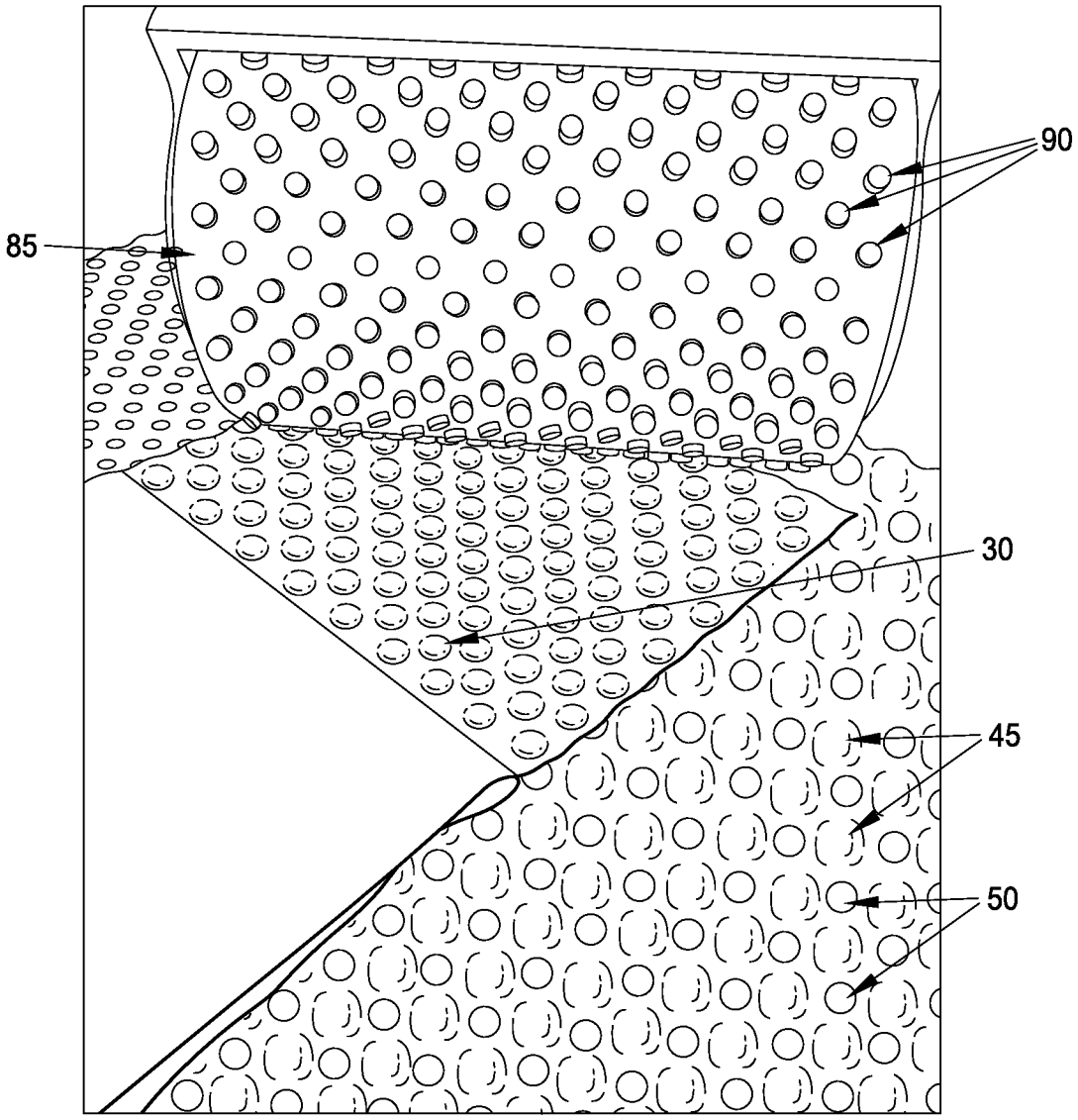
Figure 23:
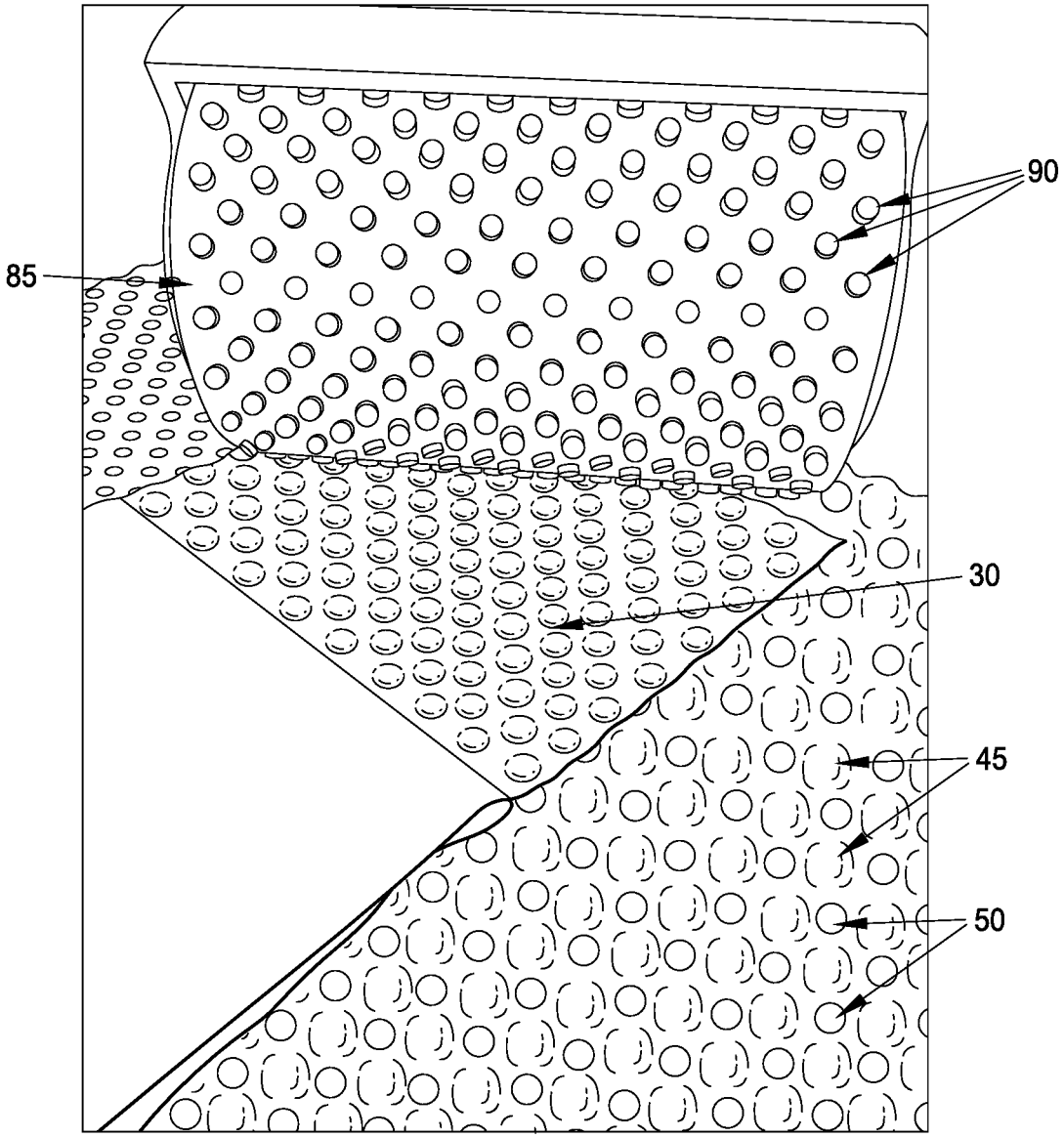
Figure 24:
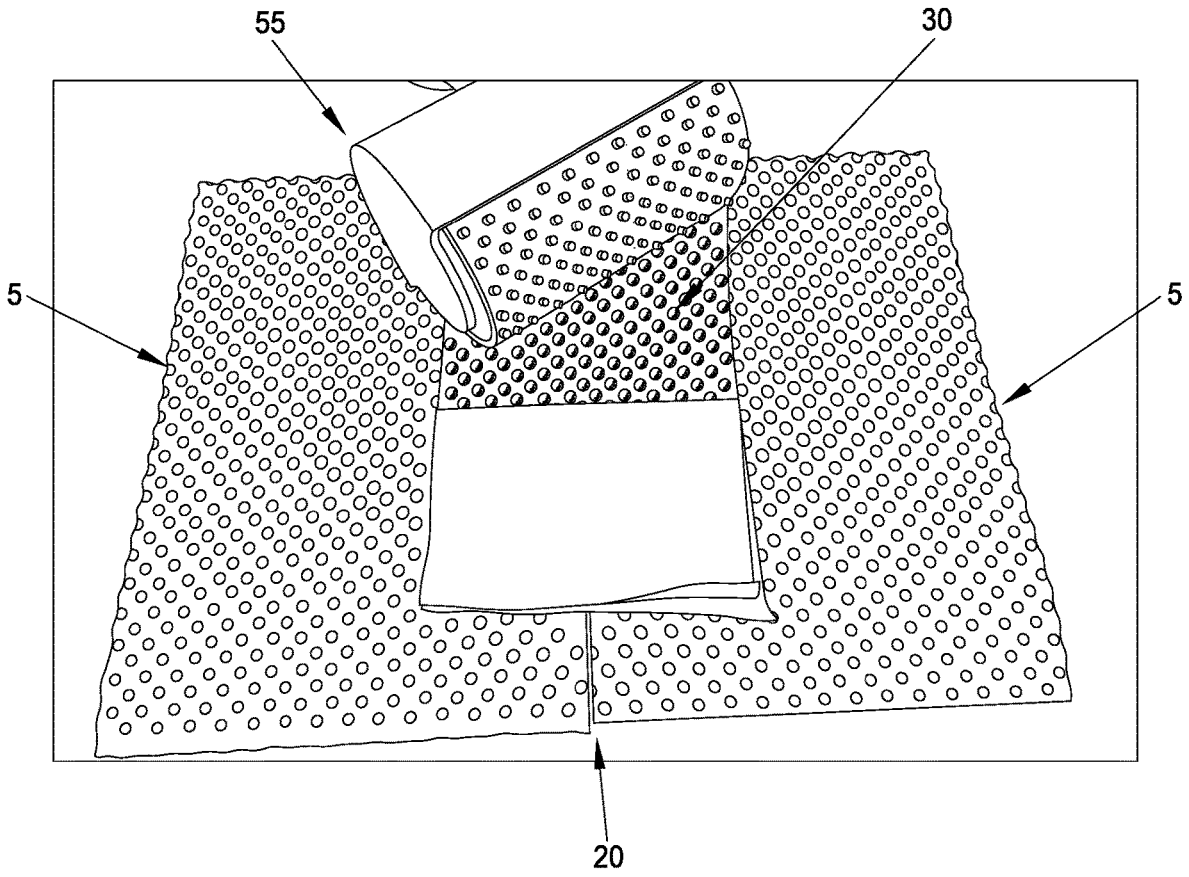
Figure 25:
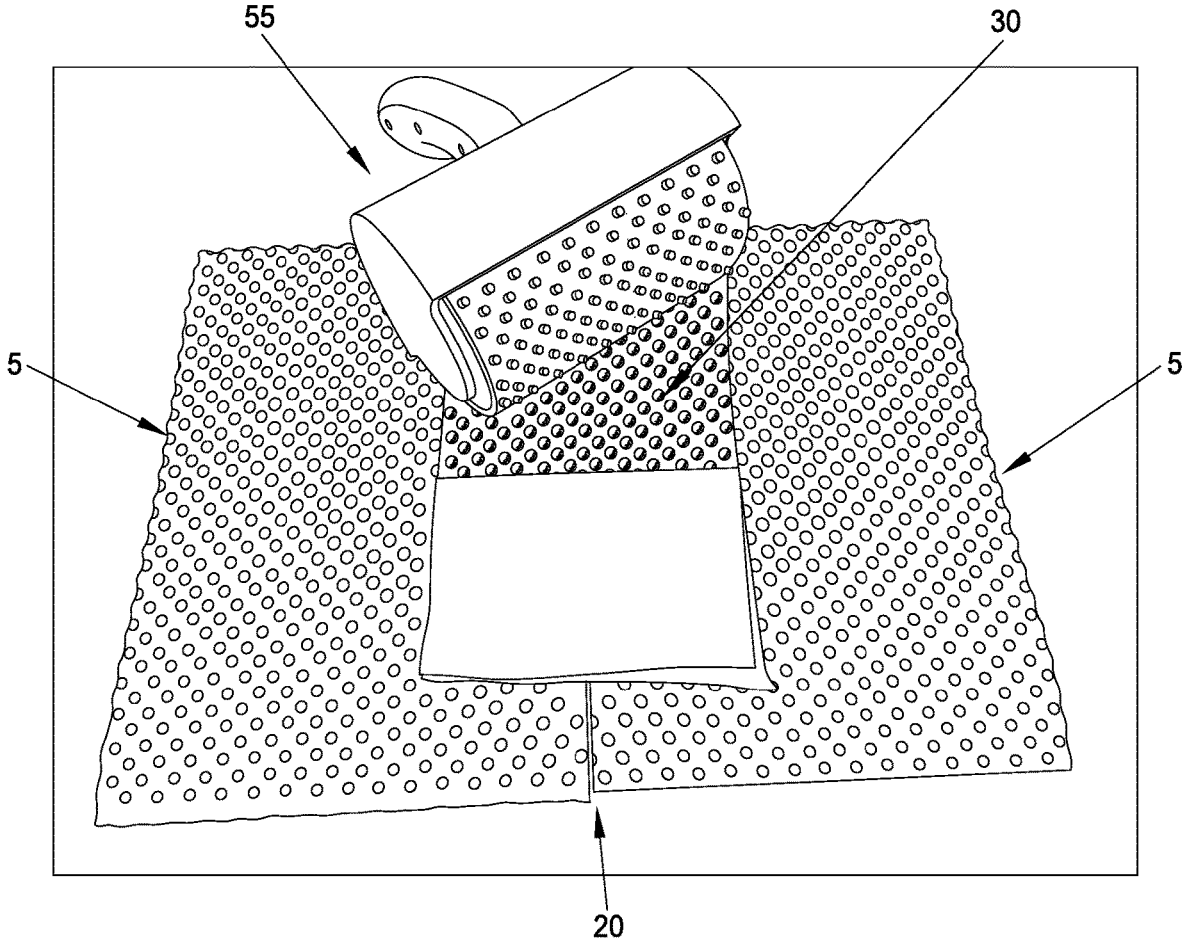
Figure 26:
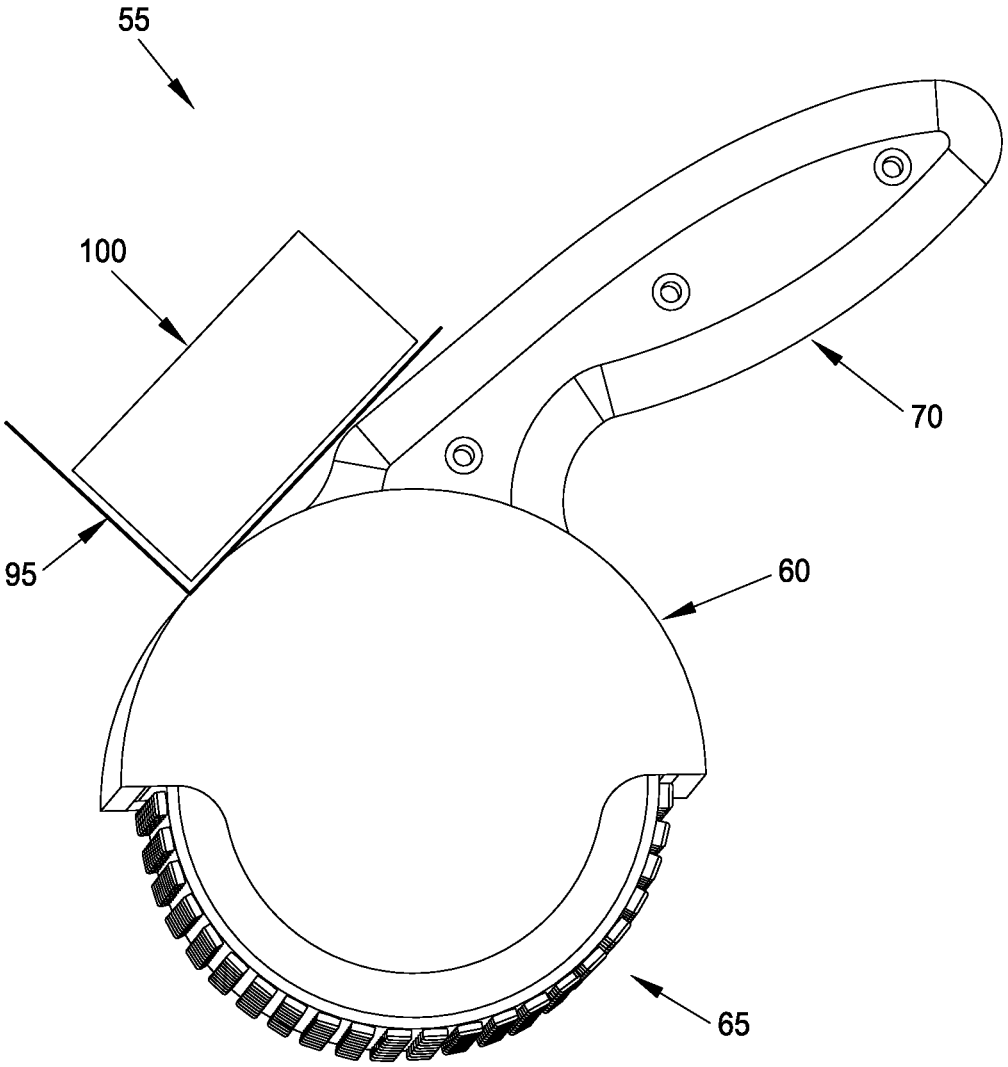
FIG. 26 is a schematic view showing an alternative construction for the novel seam tape applicator of the present invention.

More particularly, the present invention comprises the provision and use of a novel seam tape applicator 55 (FIGS. 12-25) which applies self-adhesive seam tapes 30 to the junctions of dimpled waterproofing membranes 5 so as to render those junctions waterproof.

Looking now at FIGS. 12-17, the novel seam tape applicator 55 comprises a body 60, a roller 65 which is rotatably mounted to body 60, and a handle 70 attached to body 60. Roller 65 comprises a roller surface 75 which comprises surface features which complement the dimpled surface 40 of the waterproofing membranes 5. More particularly, the roller surface 75 of seam tape applicator 55 comprises a cylinder 80 having a smooth floor 85 and a plurality of projections 90 extending upwardly from that smooth floor 85. As seen in FIGS. 18-25, projections 90 have a size and configuration which complement the recesses 50 of the dimpled waterproofing membranes 5. As a result, and looking now at FIGS. 21-25, when self-adhesive seam tape 30 is set over a seam line 20 separating two sheets of dimpled waterproofing membranes 5 and the seam tape applicator 55 is thereafter rolled over the self-adhesive seam tape 30, the smooth floor 85 of the cylinder 80 of the seam tape applicator 55 presses the self-adhesive seam tape 30 against the upper surfaces 45 of the dimpled waterproofing membranes 5 and the projections 90 of the seam tape applicator 55 press the self-adhesive seam tape 30 into the recesses 50 of the dimpled waterproofing membranes 5, whereby to create a waterproof junction between the dimpled waterproofing membranes 5. Note that projections 90 press the self-adhesive seam tape 30 deeply into the recesses 50, to substantially the full length of projections 90 and the full depth of recesses 50 (which have substantially identical length/depth dimensions). Note further that the projection of the self-adhesive seam tape 30 into the recesses 50 is significantly different than where a flat roller 35 is used to press the self-adhesive seam tape 30 against the top surface 45 of the dimpled surfaces 40 of the dimpled waterproofing membranes 5, where there is substantially no penetration of the self-adhesive seam tape 30 into the recesses 50.

Note that the novel seam tape applicator 55 of the present invention can apply self-adhesive seam tape 30 in any direction, which allows for easy installation of the self-adhesive seam tape 30, i.e., the novel seam tape applicator 55 can be used to install self-adhesive seam tape 30 whether the installer is left-handed or right-handed, and even when obstructions (such as pipes) dictate how the seam tape applicator 55 must be held. The novel seam tape applicator 55 can also accommodate self-adhesive seam tapes 30 of different widths.

Note also that the seam tape applicator 55 can be provided with interchangeable handles 70 (e.g., with various handle lengths) so that the seam tape applicator 55 may be used when the installer is in different positions (e.g., kneeling, standing, etc.).

And note that the novel seam tape applicator 55 is preferably provided with sufficient weight to help apply pressure to the self-adhesive seam tape 30 when applying the self-adhesive seam tape 30 to various surfaces. Alternatively and/or additionally, the seam tape applicator 55 may be provided with means for adding weight to the seam tape applicator 55 when desired, e.g., a platform 95 mounted to body 60, where the platform 95 can receive one or more weights 100 so as to add weight to the seam tape applicator 55.

It should also be appreciated that, inasmuch as the dimpled waterproofing membranes 5 may have a variety of different surface configurations, the novel seam tape applicator 55 may also have a variety of different roller surface configurations. The important point is that the surface configurations of the novel seam tape applicator 55 provide a complementary surface to the surface configurations of the dimpled waterproofing membranes 5, so that the projections 90 on the seam tape applicator 55 can force the self-adhesive seam tape 30 down into the recesses 50 of the dimpled waterproofing membranes 5.

Note also that, if desired, the surface configurations of the novel seam tape applicator 55 may not be a perfect (i.e., complete) complement to the surface configurations of the dimpled waterproofing membranes 5, e.g., the surface configuration of the novel seam tape applicator 55 may provide projections 90 for only 75% of the recesses 50 of the dimpled waterproofing membranes 5, or 50% of the recesses 50 of the dimpled waterproofing membranes 5, etc. In other words, the number of projections 90 for a given surface area of the roller surface 75 may be less than the number of recesses 50 for a given surface area of the dimpled waterproofing membranes 5 provided, however, that the spacing and size of the projections 90 is such that each projection 90 can be received in a recess 50 of a dimpled waterproofing membrane 5. For the purposes of the present invention, such an "incomplete complement" construction of roller surface 75 is still considered to be a complement of dimpled surface 40.

Modifications Of The Preferred Embodiments

It should be understood that many additional changes in the details, materials, steps and arrangements of parts, which have been herein described and illustrated in order to explain the nature of the present invention, may be made by those skilled in the art while still remaining within the principles and scope of the invention.

What is claim is:

1. A method for applying self-adhesive seam tapes to the junctions of dimpled waterproofing membranes, wherein the dimpled waterproofing membranes comprise dimpled surfaces, the method comprising:

providing a seam tape applicator comprising:

a body;

a roller which is rotatably mounted to the body; and a handle which is attached to the body;

wherein the roller comprises a roller surface which comprises surface features which complement the dimpled surfaces of the dimpled waterproofing membranes;

positioning a self-adhesive seam tape over a seam line separating two sheets of dimpled waterproofing membranes; and rolling the seam tape applicator over the self-adhesive seam tape, with the roller surface of the seam tape applicator engaging the self-adhesive seam tape so as to press the self-adhesive seam tape into the dimpled surfaces of the dimpled waterproofing membranes.

2. A method according to claim 1 wherein the dimpled surfaces of the dimpled waterproofing membranes comprise upper surfaces and recesses, wherein the roller surface of the seam tape applicator comprises a cylinder having a smooth floor and a plurality of projections extending upwardly from the smooth floor, wherein the plurality of projections have a size and configuration which complement the recesses of the dimpled waterproofing membranes, and further wherein pressing the self-adhesive seam tape into the dimpled surfaces of the dimpled waterproofing membranes comprises pressing the self-adhesive seam tape into at least some of the recesses disposed beneath the self-adhesive seam tape.

3. A method according to claim 1 wherein the roller surface of the seam tape applicator provides a perfect complement to the dimpled surface of the dimpled waterproofing membranes.

4. A method according to claim 1 wherein the roller surface of the seam tape applicator provides an incomplete complement to the dimpled surface of the dimpled waterproofing membranes.

5. A method according to claim 1 wherein the seam tape applicator further comprises a structure for adding weight to the seam tape applicator.

6. A system for creating a waterproof structure, the system comprising:

two sheets of dimpled waterproofing membranes, the two sheets of dimpled waterproofing membranes comprising dimpled surfaces, and the two sheets of dimpled waterproofing membrane having a junction;

a self-adhesive seam tape configured to overlie portions of the two sheets of dimpled waterproofing membranes so as to cover the junction; and a seam tape applicator for applying the self-adhesive seam tape to the portions of the two dimpled waterproofing membranes so as to cover the junction, the seam tape applicator comprising:

a body;

a roller which is rotatably mounted to the body; and a handle which is attached to the body;

wherein the roller comprises a roller surface which comprises surface features which complement the dimpled surfaces of the dimpled waterproofing membranes.

7. A system according to claim 6 wherein the dimpled surfaces of the dimpled waterproofing membranes comprise upper surfaces and recesses, wherein the roller surface of the seam tape application comprises a cylinder having a smooth floor and a plurality of projections extending upwardly from the smooth floor, and further wherein the plurality of projections have a size and configuration which complement the recesses of the dimpled waterproofing membranes.

8. A system according to claim 6 wherein the roller surface of the seam tape applicator provides a perfect complement to the dimpled surface of the dimpled waterproofing membranes.

9. A system according to claim 6 wherein the roller surface of the seam tape applicator provides an incomplete complement to the dimpled surface of the dimpled waterproofing membranes.

10. A system according to claim 6 wherein the seam tape applicator further comprises a structure for adding weight to the seam tape applicator.

* * * * *